US011011290B2

(12) United States Patent
Abe et al.

(10) Patent No.: US 11,011,290 B2
(45) Date of Patent: May 18, 2021

(54) METHOD FOR MANUFACTURING RESISTOR, AND RESISTOR

(71) Applicant: KOA CORPORATION, Ina (JP)

(72) Inventors: Yuichi Abe, Ina (JP); Seiji Karasawa, Ina (JP); Michio Kubota, Ina (JP); Yoji Gomi, Ina (JP); Koichi Minowa, Ina (JP)

(73) Assignee: KOA CORPORATION, Ina (JP)

( * ) Notice: Subject to any disclaimer, the term of this patent is extended or adjusted under 35 U.S.C. 154(b) by 0 days.

(21) Appl. No.: 16/903,674

(22) Filed: Jun. 17, 2020

(65) Prior Publication Data

US 2020/0312490 A1 Oct. 1, 2020

Related U.S. Application Data

(63) Continuation-in-part of application No. 16/771,334, filed as application No. PCT/JP2018/045457 on Dec. 11, 2018, now Pat. No. 10,892,074.

(30) Foreign Application Priority Data

Dec. 12, 2017 (JP) ..... JP2017-237821

(51) Int. Cl.
*H01C 17/28* (2006.01)

(52) U.S. Cl.
CPC ..... *H01C 17/28* (2013.01)

(58) Field of Classification Search
CPC ..... H01C 17/281; H01C 13/00; H01C 7/003; H01C 1/02
See application file for complete search history.

(56) References Cited

U.S. PATENT DOCUMENTS 6,558,783 B1 5/2003 Kato et al.
7,190,252 B2 3/2007 Smith et al.
(Continued)

FOREIGN PATENT DOCUMENTS

JP 53-14133 U 2/1978
JP 59-177929 U 11/1984
(Continued)

OTHER PUBLICATIONS

Decision to Grant a Patent dated Jul. 16, 2019, issued in counterpart JP application No. 2017-237821, with English translation (5 pages).
(Continued)

*Primary Examiner* — Kyung S Lee
(74) *Attorney, Agent, or Firm* — Westerman, Hattori, Daniels & Adrian, LLP

(57) ABSTRACT

The present disclosure provides a method for manufacturing a resistor. The method may include providing a resistor structure having a layer of first thermally conductive material covering at least a surface of the resistive body, the first thermally conductive material being semi-cured, semi-hardened and substantially non-fluid, and the layer of first thermally conductive material having a first thickness; bending a pair of electrodes at the opposite ends of the resistive body toward a surface of the layer of first thermally conductive material; and pressing the pair of electrodes against the surface of the layer of first thermally conductive material, while maintaining in a heated state the first thermally conductive material to cause further curing and hardening of the first thermally conductive material and a reduction in the first thickness, so as to obtain a cured and hardened thermally conductive layer having a desired second thickness.

10 Claims, 7 Drawing Sheets

(56) References Cited

U.S. PATENT DOCUMENTS

| | | | | |
|---|---|---|---|---|
| 10,892,074 | B2 * | 1/2021 | Abe | H01C 17/02 |
| 2004/0156177 | A1 | 8/2004 | Higashitani | |
| 2006/0197648 | A1 | 9/2006 | Smith et al. | |
| 2009/0224865 | A1 | 9/2009 | Tanaka et al. | |

FOREIGN PATENT DOCUMENTS

| | | | |
|---|---|---|---|
| JP | 9-181448 | A | 7/1997 |
| JP | 11-162721 | A | 6/1999 |
| JP | 2004-128000 | A | 4/2004 |
| JP | 2008-532280 | A | 8/2008 |
| JP | 4806421 | B2 | 11/2011 |
| JP | 2015-8316 | A | 1/2015 |

OTHER PUBLICATIONS

Notice of Reasons for Refusal dated Feb. 26, 2019, issued in counterpart JP application No. 2017-237821, with English translation (8 pages).

International Search Report dated Mar. 5, 2019, issued in counterpart International Application No. PCT/JP2018/045457 (2 pages).

* cited by examiner

METHOD FOR MANUFACTURING RESISTOR, AND RESISTOR

CROSS-REFERENCE TO RELATED APPLICATIONS

The present patent application is a Continuation-in-Part of U.S. application Ser. No. 16/771,334, filed Jun. 10, 2020, which is a National Stage of PCT Application No. PCT/JP2018/045457, filed Dec. 11, 2018, claiming priority to Japanese Application No. 2017-237821, filed Dec. 12, 2017, each of which is incorporated herein by reference in its entirety.

BACKGROUND OF THE INVENTION

Technical Field

The present disclosure relates to a method for manufacturing a resistor having a thermally conductive layer with a controlled, uniform thickness. The method according to the present disclosure allows precise and accurate adjustment of electrical resistance to provide a resistor with a predetermined resistance.

Background Art

Patent Literature 1 discloses a resistor and a method of manufacturing the resistor. The resistor described in Patent Literature 1 comprises a resistive element, a pair of terminations or electrodes extending from opposite ends of the resistive element and folded beneath the bottom of the resistive element, and an electrically insulative filler, which forms a thermally conductive layer disposed between the resistive element and the terminations.

In the resistor described in Patent Literature 1, the filler exhibits an adhesion strength to bond the resistive element to the terminations, while providing a heat dissipation capability in which heat is conducted from the resistive body to the electrodes via the filler. Similar structures are also disclosed in Patent Literatures 2 to 4.

LIST OF REFERENCES

Patent Literature 1: Japanese Patent No. 4806421, corresponding to U.S. Pat. No. 7,190,252

Patent Literature 2: Japanese Unexamined Patent Application Publication No. 2004-128000

Patent Literature 3: United States Patent Application Publication No. 2004/0156177

Patent Literature 4: U.S. Pat. No. 6,558,783

BRIEF SUMMARY

In the background art described above, an uncured and unhardened filler material is initially disposed on the surface of the resistive element, and the electrodes are bent into contact with the filler material while the filler material is uncured and unhardened, and therefore, fluid. Only after the electrodes are bent into contact with the filler is the filler cured and hardened to form a thermally conductive layer.

Specifically, in the aforementioned background art, the filler remains uncured and fluid when heat and pressure are applied to the filler in contact with the bent electrodes. Even if the filler is an uncured and unhardened film, thus not fluid, it becomes fluid upon application of heat. But the fluidity of the filler tends to cause the filler to become deformed or displaced when pressure is applied during manufacturing. The tendency of the filler to lose its shape and change its dimensions in turn makes it difficult to control and maintain uniformity in the thickness of the filler during the course of manufacturing, and in turn, can cause variations in the thickness of the filler between the resistive element and the electrodes.

As such, the resistor and the associated structure disclosed in Patent Literatures 1 to 4 have a problem in that the heat dissipation capability and adhesive strength may vary from product to product as a result of a thermally conductive layer of filler with inconsistent, non-uniform thickness.

Further, since the filler during manufacturing tends to exhibit a high fluidity, the background art processes do not provide an efficient procedure for obtaining an intermediate resistor structure which would facilitate flexible, accurate adjustment of electrical resistance. The failure to provide an intermediate resistor structure ultimately translates into reduced flexibility in adjusting the resistance value exhibited by the resistor produced through the background art processes.

One aspect of the present patent application is to provide a method for manufacturing a resistor, wherein a thermally conductive material being semi-cured, semi-hardened and substantially non-fluid is provided on a resistor structure formed of a resistive body and a pair of electrodes on opposite ends of the resistive body, followed by bending the electrodes toward the resistive body and subsequently applying heat and pressure to completely cure and harden the thermally conductive material into a cured and hardened thermally conductive layer interposed between the resistive body and the electrodes. The method may include thermal process for semi-curing or semi-hardening an uncured, unhardened thermally conductive material to obtain the thermally conductive material being semi-cured, semi-hardened, and substantially non-fluid on the resistor structure.

The method according to the present patent application enables increased flexibility in controlling the thickness of the thermally conductive layer, leading to enhanced uniformity and reduced variations in the thickness of the thermally conductive layer. The method according to the present patent application also enables increased flexibility and accuracy in adjusting the electrical resistance of the resistor.

A method for manufacturing a resistor according to an embodiment of the present disclosure may comprise the steps of: providing a resistor structure comprising a resistive body, a pair of electrodes on opposite ends of the resistive body, and a layer of first thermally conductive material covering at least a surface of the resistive body, the first thermally conductive material being semi-cured, semi-hardened and substantially non-fluid, and the layer of first thermally conductive material having a first thickness; bending the pair of electrodes at the opposite ends of the resistive body toward a surface of the layer of first thermally conductive material; and pressing the pair of electrodes against the surface of the layer of first thermally conductive material, while maintaining in a heated state the first thermally conductive material to cause further curing and hardening of the first thermally conductive material and a reduction in the first thickness, so as to obtain a cured and hardened thermally conductive layer having a desired second thickness, so that the resistive body, the cured and hardened thermally conductive layer and the pair of electrodes are firmly bonded to each other.

In some embodiments, the step of providing the resistor structure may comprise: forming an elongated bonded body by adhering a pair of electrode members to opposite surfaces of an elongated resistor body member, and applying a layer of second thermally conductive material on at least a surface of the elongated resistor body member, the second thermally conductive material being uncured and unhardened; partially curing the layer of second thermally conductive material; and cutting out the resistor structure from the elongated bonded body.

In some embodiments, the first thermally conductive material may have a degree of hardness substantially in the range of from 30% to 70% of a degree of hardness of the cured and hardened thermally conductive layer.

In some embodiments, the method for manufacturing a resistor may further comprise, before bending the pair of electrodes, forming a plurality of cuts in at least the resistive body.

In some embodiments, the method for manufacturing a resistor may further comprise, before applying the layer of first thermally conductive material to at least the surface of the resistive body, forming a plurality of cuts in the resistive body.

In some embodiments, the first thermally conductive material may have a degree of cure in the range of from 30% to less than 70%.

In some embodiments, the cured and hardened thermally conductive layer may have a degree of cure equal to or higher than 70%.

In some embodiments, the first thickness may be at most 5-25% thicker than the second thickness.

In some embodiments, the second thickness may be in the range of from 50 μm to 95 μm.

In some embodiments, the layer of first thermally conductive material may cover a downward-facing surface of the resistive body, and the pair of electrodes are bent downward toward the surface of the layer of first thermally conductive material.

Compared to a background art method, a method for manufacturing a resistor according to the present patent application enables increased control of the thickness of the thermally conductive layer, leading to enhanced uniformity and reduced variations in the thickness of the thermally conductive layer. The ability to accurately adjust the thickness of the thermally conductive layer translates into the ability to manufacture a resistor with reduced variations and increased consistency in the heat dissipation capability and adhesive strength. Moreover, the method according to the present patent application provides an intermediate resistor structure for further processing into a finished resistor product, which leads to increased flexibility in accurately adjusting the electrical resistance of the resistor.

BRIEF DESCRIPTION OF THE DRAWINGS

The subject matter that is regarded as the invention is better understood by reading the following detailed description with reference to the accompanying drawing figures, in which like reference numerals refer to like elements throughout, and in which.

Figure 1A:
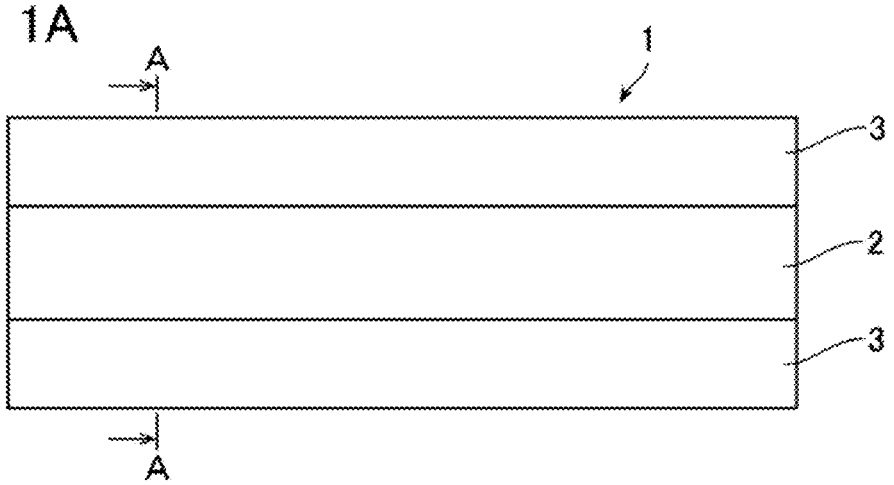
FIG. 1A is a plan view schematically illustrating a primary elongated bonded body obtained during an embodiment of a method of manufacturing a resistor according to the present disclosure.

The various features of the drawings are not to scale as the illustrations are for clarity in facilitating one skilled in the art in understanding the invention in conjunction with the detailed description.

DETAILED DESCRIPTION

Next, the embodiments of the present disclosure will be described clearly and concretely in conjunction with the accompanying drawings, which are described briefly above. The subject matter of the present disclosure is described with specificity to meet statutory requirements. However, the description itself is not intended to limit the scope of this disclosure. Rather, the inventors contemplate that the claimed subject matter might also be embodied in other ways, to include different steps or elements similar to the ones described in this document, in conjunction with other present or future technologies.

While the present technology has been described in connection with the embodiments of the various figures, it is to be understood that other similar embodiments may be used or modifications and additions may be made to the described embodiments for performing the same function of the present technology without deviating therefrom. Therefore, the present technology should not be limited to any single embodiment, but rather should be construed in breadth and scope in accordance with the appended claims. In addition, all other embodiments obtained by one of ordinary skill in the art based on embodiments described in this document are considered to be within the scope of this disclosure.

In describing preferred embodiments of the present disclosure illustrated in the drawings, specific terminology is employed for the sake of clarity. However, the present disclosure is not intended to be limited to the specific terminology so selected, and it is to be understood that each specific element includes all technical equivalents that operate in a similar manner to accomplish a similar purpose.

Referring now to the drawings, in which corresponding parts are identified with the same reference numeral, a method for manufacturing a resistor according to the present disclosure is described.

(Method for Manufacturing a Resistor)

Referring to FIGS. 1A through 8B, individual steps included in the method for manufacturing a resistor according to the present patent application are described in the order they are performed.

Figure 1B:
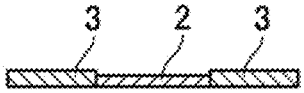
FIG. 1B is a cross-sectional view of the primary elongated bonded body illustrated in FIG. 1A, taken along line A-A.

In the step depicted in FIGS. 1A and 1B, a resistive body member 2 and a plurality of electrode members 3 are prepared. Each of the resistive body member 2 and the electrode members 3 may have a flat plate shape or a belt-like shape. In the embodiment depicted in FIGS. 1A and 1B, each of the resistive body member 2 and the electrode members 3 has an elongated, belt-like shape.

In the step depicted in FIGS. 1A and 1B, the elongated electrode members 3 are fastened to opposite sides of the resistive body member 2 to produce primary bonded body 1. The process of fastening the electrode members 3 to the resistive body member 2 is not particularly limited, and may be any suitable process known to a person of ordinary skill in the art, so long as the process is capable of firmly attaching the electrode members 3 to the resistive body member 2. For example, the electrode members 3 may be fastened to the resistive body member 2 through laser welding.

In some embodiments, the primary bonded body 1 is formed in an elongated, belt-like shape by joining the elongated resistive body member 2 and the elongated electrode members 3 together, for example, as shown in FIG. 1A. The elongated primary bonded body 1 may be readily wound into a roll for placing on a production line to enable automation of subsequent manufacturing procedure for mass-production of the resistors.

The present disclosure does not particularly limit the thickness of each of the resistive body member 2 and the electrode member 3. For example, the resistive body member 2 may have a thickness ranging from several tens of micrometers (μm) to several hundreds of μm. A person of ordinary skill in the art would appreciate that the thicknesses for the resistive body member 2 and the electrode member 3 may be suitably selected based on need and preferences. The resistive body member 2 may have either substantially the same thickness as, or a different thickness than, that of the electrode member 3.

Any suitable material may be used for forming the resistive body member 2 and the electrode member 3. For example, the resistive body member 2 may be formed using a metallic resistance material, such as copper-nickel and nickel-chrome, a composite material formed of an insulative substrate with its surface coated with metal film, a conductive ceramic substrate, and the like. For example, the electrode member 3 may be formed using copper, silver, nickel, chrome, and the like, as well as an alloy comprising any combination thereof.

In some embodiments, to fasten the electrode members 3 to the sides of the resistive body member 2, the side edge of the resistive body member 2 may be brought into abutment with the edge of the electrode member 3 at each side of the resistive body member 2, as shown in FIG. 1B. Alternatively, the surfaces of the resistive body member 2 and the electrode members 3 may be partially superimposed upon one another at the positions where the resistive body member 2 and the electrode members 3 are fastened together.

In other embodiments, the resistive body member 2 and the electrode members 3 may be integrally formed. That is, the resistive body member 2 and the electrode members 3 may be formed as a unitary structure, for example, out of a single continuous material such as a single metal resistance plate. In some embodiments, those portions of a metal resistance plate which serve as electrode members 3 may be selectively coated, for example, by plating with a low-resistance metallic material, so as to obtain the electrode members 3 on the plated surfaces of the metal resistance plate.

Figure 2A:
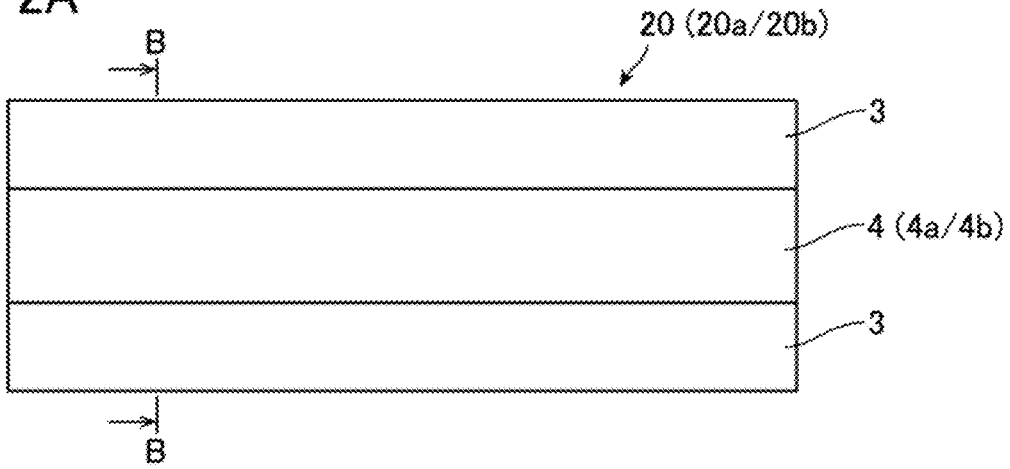
FIG. 2A is a plan view schematically illustrating a secondary elongated bonded body prepared from the primary elongated bonded body of FIGS. 1A and 1B.
Figure 2B:
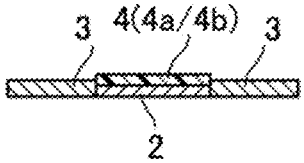
FIG. 2B is a cross-sectional view of the secondary elongated bonded body illustrated in FIG. 2A, taken along line B-B.

After forming the primary bonded body 1, an uncured, unhardened thermally conductive material is applied onto at least the surface of the resistive body member 2 to obtain a secondary bonded body 20*a*. For example, as shown in FIGS. 2A and 2B, an uncured, unhardened thermally conductive material 4*a* is applied onto the surface of the resistive body member 2 to obtain an elongated, secondary bonded body 20*a*. Preferably, the thermally conductive material 4*a* is an electrically insulating thermosetting resin with high thermal conductivity. For example, the thermally conductive material 4*a* may be a thermosetting resin such as epoxy and polyimide.

The uncured, unhardened thermally conductive material 4*a* may be provided in the form of a film or a paste. In some embodiments, a solidified but uncured, unhardened thermally conductive resin film may be adhered onto the surface of the resistive body member 2. In some embodiments, an unsolidified, uncured, and unhardened thermally conductive resin paste may be applied onto the surface of the resistive body member 2. It is understood that even though the thermally conductive resin paste is unsolidified, it is minimally cured to be capable of being applied. The thermally conductive resin paste may be applied onto the resistive body member 2 by any suitable process known to a person of ordinary skill in the art, including, but not limited to, via a doctor blade or a specialized applicator.

The thickness of the thermally conductive layer 104*c* in the final finished resistor product may be suitably determined based on the desired thermal conductivity of the resistor and the secure fixation of the resistive body and the electrodes to each other. For example, preferably, the thickness of the thermally conductive layer 104*c* in the final finished resistor product may be in a range of from approximately 10 μm to approximately 200 μm. This range corresponds to the thickness of the thermally conductive layer 4 after it is completely cured to produce the final finished resistor product, as will be described later.

In the method for manufacturing a resistor according to the present disclosure, as described later, the layer of uncured, unhardened thermally conductive material 4*a* undergoes a first curing to become semi-cured and semi-hardened, which is followed by a second curing with heat and pressure to become fully cured and hardened, during which the thermally conductive material may regain certain fluidity to assume a slightly reduced thickness. To compensate for this slight reduction in thickness, the thickness of the uncured, unhardened thermally conductive material 4*a* upon application on the surface of the resistive body member 2 is preferably slightly greater than the desired thickness of the finished, completely cured, hardened thermally conductive layer 104*c*.

In some embodiments, the thickness of the uncured, unhardened thermally conductive material 4*a* is at most about double the desired thickness of the finished, completely cured, hardened thermally conductive layer 104*c*. More preferably, the thickness of the uncured, unhardened thermally conductive material 4*a* is at most about 25% thicker than the desired thickness of the finished, completely cured, hardened thermally conductive layer 104*c*. Most preferably, the thickness of the uncured, unhardened thermally conductive material 4*a* is at most about 5% thicker than the desired thickness of the finished, completely cured, hardened thermally conductive layer 104*c*. As an illustrative, non-limiting example, if the desired thickness of the completely cured, hardened thermally conductive layer 104*c* is 50-95 μm, then the thickness of the uncured, unhardened thermally conductive material 4*a* would be applied on the resistive body member 2 so as to have a thickness of approximately 100 μm.

Although the thermally conductive material on the surface of the resistive body member 2 may become temporarily fluid during the second curing, the effect of such temporary fluidity on the thickness of the resistor is made insignificant by the first curing during which the thermally conductive material substantially loses its fluidity to become semi-cured and semi-hardened. Such ability to minimize temporary fluidity during subsequent thermal processing allows for accurate, precise control of the thickness of the thermally conductive layer 104*c* in the final resistor product.

As used herein, the terms "uncured" and "unhardened" refer to a state in which a thermally conductive material is not cured or hardened. Specifically, the uncured, unhardened state represents a state in which curing or hardening reaction has hardly proceeded such that the thermally conductive material retains substantially the same fluidity as that exhibited upon initial application on the resistor body member. In some embodiments, the uncured, unhardened state may be a state in which the degree of cure or hardness is greater than 0%, but is at most 5%.

In some embodiments, the thermally conductive material may be a pre-manufactured, commercially available, purchased thermally conductive material, and in such embodiments, the uncured, unhardened state represents the state of the product as shipped where the thermally conductive material is not cured or hardened.

Further, the terms "cured" (or "completely cured") and "hardened" (or "completely hardened") refer to a state in which a thermally conductive material has completely lost its fluidity, for instance, owing to the polymerization reactions that form crosslinks in the resinous thermally conductive material.

In some embodiments, where the uncured, unhardened thermally conductive material 4*a* is a thermally conductive resin film, after applying the thermally conductive resin film onto the resistive body member 2, the thermally conductive resin film may be subject to pre-processing including temporary pressure-bonding. In that case, the thermally conductive resin film remains in the uncured, unhardened state after the pre-processing. That is, during the pre-processing, the thermally conductive resin film is heated at a temperature equal to or lower than a predetermined application temperature (e.g., an experimentally determined temperature, or a manufacturer's prescribed temperature for curing the particular thermally conductive material) for a short period of time, for example, several minutes or so, to temporarily adhere or pressure-bond the thermally conductive resin film 4*a* onto the resistive body member 2. The thermally conductive resin film 4*a* after heating during the pre-processing is still in the "uncured, unhardened" state.

Where the uncured, unhardened thermally conductive material 4*a* is a thermally conductive resin film, the thermally conductive resin film 4*a* may be in a solidified but uncured, unhardened state. The term "solidified" refers to a state in which the thermally conductive material is, or has become, solid.

In some embodiments, where the uncured, unhardened thermally conductive material 4*a* is a thermally conductive resin paste, the thermally conductive resin paste may be in an uncured, unhardened, and unsolidified state. The term "unsolidified" refers to a state in which the thermally conductive material contains a solid component either partially or entirely dispersed in a solvent, and may include a state or material such as a slurry. It is understood that even though the thermally conductive resin paste is unsolidified, it is minimally cured to be capable of being applied. The thermally conductive resin paste may be applied onto the resistive body member 2 by any suitable process known to a person of ordinary skill in the art, including, but not limited to, via a doctor blade or a specialized applicator.

In the embodiments shown in FIGS. 2A and 2B, the thermally conductive material 4*a* is applied only onto the surface of the elongated resistive body member 2.

However, in some embodiments, the thermally conductive material 4*a* may be applied to cover the surfaces of the resistive body member 2 and the electrode members 3. For example, the thermally conductive material 4*a* may cover an entirety of the surfaces of the resistive body member 2 and the electrode members 3, as shown in FIG. 2C.

As another example, the thermally conductive material 4*a* may cover an entirety of the surface of the resistive body member 2 and only partially the surfaces of the electrode members 3 at the positions where the electrode members 3 adjoin the resistive body member 2.

As still another example, the thermally conductive material 4*a* may be deposited outside of the areas surrounding the bend or fold lines along which the electrodes 103, which are formed from the electrode members 3, are bent during subsequent procedure, described later. That is, the thermally conductive material 4*a* may be deposited in three elongated areas, one on each of the resistive body member 2 and the pair of electrode members 3, divided from each other by the boundary between the resistive body member 2 and the electrode member 3.

Figure 2C:
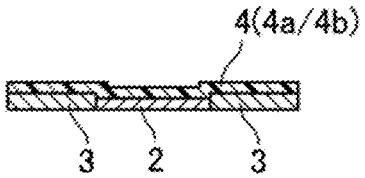
FIG. 2C is a cross-sectional view of a secondary elongated bonded body according to another embodiment of the present disclosure.

Providing the thermally conductive material 4*a* across the surfaces of the resistive body member 2 and the electrode members 3, for example, as depicted in FIG. 2C, may facilitate the formation of the thermally conductive layer.

For example, where the thermally conductive material 4*a* is a thermally conductive resin film, application of the thermally conductive material 4*a* does not require precise positioning relative to the resistive body member 2. Rather, a thermally conductive resin film 4*a* that is large enough to cover both the resistive body member 2 and the electrode members 3 may be directly applied onto the surfaces of the resistive body member 2 and the electrode members 3, as depicted in FIG. 2C.

Where the thermally conductive material 4*a* is a thermally conductive resin paste, the thermally conductive resin paste 4*a* may be applied throughout the surfaces of the resistive body member 2 and the electrode members 3.

Hence, manufacturing may be simplified by providing the uncured, unhardened thermally conductive material 4*a* not only on the surface of the resistive body member 2, but also on the surfaces of the electrode members 3.

After the uncured, unhardened thermally conductive material 4*a* is applied onto the resistive body member 2 (and in some embodiments, also onto the electrode members 3), the uncured, unhardened thermally conductive material 4*a* undergoes a first curing to obtain a semi-cured, semi-hardened, substantially non-fluid thermally conductive material 4*b*.

The uncured, unhardened thermally conductive material 4 is heated into a semi-cured, semi-hardened, substantially non-fluid state, thereby obtaining a secondary bonded body 20*b* comprising the layer of semi-cured, semi-hardened, substantially non-fluid thermally conductive material 4*b* on the surface of the resistive body member 2 (and in some embodiments, also onto the electrode members 3).

In the embodiments shown in FIGS. 2A to 2C, the uncured, unhardened thermally conductive material 4*a* (on the surface of the resistive body member 2 in FIGS. 2A and 2B, and also on the surfaces of the electrode members 3 in FIG. 2C) is cured to form a layer of semi-cured, semi-hardened, substantially non-fluid thermally conductive material 4*b*, so as to obtain an elongated, secondary bonded body 20*b*.

As shown in FIGS. 2A to 2C, the thermally conductive material 4*a* is applied to an upward-facing surface of the resistive body member 2 (and in some embodiments, also to the upward-facing surfaces of the electrode members 3). In some embodiments, however, the resistive body member 2 and the electrode members 3 are oriented during manufacturing so that the uncured, unhardened thermally conductive material 4*a* is applied to the downward-facing surface of the resistive body member 2 (and in some embodiments, also on the downward-facing surfaces of the electrode members 3), for example, in order to form the resistor structure shown in FIGS. 8A and 8B.

As used herein, the terms "semi-cured" and "semi-hardened" refer to an intermediate state wherein the thermally conductive material is, or has become, substantially non-fluid, that is, the state that is intermediate of the "uncured, unhardened" state and the "completely cured, hardened" state.

Determination as to whether or not the thermally conductive material is in a semi-cured, semi-hardened state may be made based on the degree of cure or hardness, viscosity, thermal processing conditions or the like. For example, the degree of cure or hardness of the thermally conductive material may be calculated based on the amount of heat released from the sample in differential scanning calorimetry (DSC) analysis.

More specifically, a semi-cured, semi-hardened state represents an intermediate state in which the thermally conductive material has undergone curing and hardening, but only to the extent that further curing or hardening is still possible. As such, where the state of the thermally conductive material is determined based on the degree of cure or hardness, for example, a semi-cured, semi-hardened thermally conductive material a degree of cure or hardness that is higher than that exhibited in the previous state (i.e., the uncured, unhardened state, or the state prior to the heat treatment for the first curing), but that is less than the degree of cure or hardness of the completely cured and hardened material (i.e., after the second curing).

The degree of hardness of the semi-cured, semi-hardened, and substantially non-fluid thermally conductive material may be substantially in the range of from about 30% to about 70% of a degree of hardness of the completely cured and hardened thermally conductive layer.

In some embodiments, the semi-cured, semi-hardened state may be a state in which the degree of cure is in the range from 30% to less than 70%, such that the fluidity is substantially lost, or a state generally referred to in the art as "B stage." An uncured, unhardened state may be a state in which the degree of cure or hardness is greater than 0%, but is at most about 5%.

Determination as to whether or not the thermally conductive material is in the "completely cured, hardened" state may be made based on the degree of cure, the thermal processing condition or the like. For example, the degree of cure or hardness of the thermally conductive material may be calculated based on the amount of heat released from the sample in differential scanning calorimetry (DSC) analysis.

In some embodiments, the completely cured, hardened state may be a state in which the degree of cure is from about 70% to about 100%, or a state generally referred to in the art as "C stage."

The uncured, unhardened thermally conductive material 4*a* after application onto the resistive body member 2 undergoes suitable thermal processing, causing the thermally conductive material 4*a* to substantially lose its fluidity and forming a layer of semi-cured, semi-hardened thermally conductive material 4*b*.

Although any suitable thermal processing may be used to transform an uncured, unhardened thermally conductive material 4*a* into a semi-cured, semi-hardened and substantially non-fluid thermally conductive material 4*b*, it is preferable to heat the thermally conductive material 4*a* at an application temperature ranging from approximately 100° C. to approximately 250° C. for a duration of approximately 5 minutes to approximately 60 minutes.

For example, the first curing of the uncured, unhardened thermally conductive material 4*a* to obtain the semi-cured, semi-hardened thermally conductive material 4*b* may be performed by heating the uncured, unhardened thermally conductive material 4*a* at a temperature identical to the application temperature used for the second curing to fully cure the semi-cured, semi-hardened thermally conductive material 4*b*. During the first curing, the uncured, unhardened thermally conductive material 4*a* may be heated for a duration of time that is approximately 10% to 50% of an application time used for the second curing.

A person of ordinary skill in the art would appreciate that the heating time and temperature required for curing or hardening process may vary depending on the particular thermally conductive material used. For example, where the thermally conductive material is a pre-manufactured, commercially available, purchased product, curing may be performed in accordance with the conditions prescribed by the manufacturer.

As discussed above, the thickness of the uncured, unhardened thermally conductive material 4*a* upon application on the surface of the resistive body member 2 is preferably slightly greater than the desired thickness of the completely cured, hardened thermally conductive layer 104*c* in the finished resistor product. After the first curing to produce the semi-cured, semi-hardened thermally conductive material 4*b* from the uncured, unhardened thermally conductive material 4*a*, the thickness of the semi-cured, semi-hardened thermally conductive material 4*b* remains the same, since no pressure is applied during the first curing and the thickness of the layer of semi-cured, semi-hardened thermally conductive material 4*b* is larger than the desired thickness of the completely cured, hardened thermally conductive layer 104*c*. As a result of the thermally conductive material being in the semi-cured, semi-hardened state, even if the thermally conductive material becomes temporarily fluid during the second curing to produce the completely cured, hardened thermally conductive layer 104*c*, the effect of such temporary fluidity on the thickness of the finished resistor product is insignificant. Such ability to minimize temporary fluidity during subsequent thermal processing allows for accurate, precise control of the thickness of the thermally conductive layer in the final resistor product.

After forming the layer of semi-cured, semi-hardened, and substantially non-fluid thermally conductive material, a plurality of resistor structures are cut out from the secondary bonded body. In the method for manufacturing a resistor according to the present disclosure, forming the resistor structure 10 from the secondary bonded body 20*b* allows for accurate adjustment of electric resistance of the resistor.

Figure 3A:
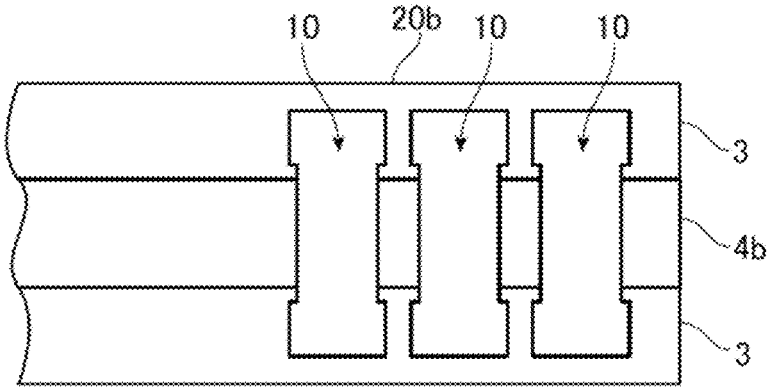
FIG. 3A is a plan view schematically illustrating formation of a plurality of resistor structures from the secondary elongated bonded body of FIGS. 2A and 2B.

In the embodiment shown in FIG. 3A, after formation of the layer of semi-cured, semi-hardened, and substantially non-fluid thermally conductive material 4*b*, a plurality of resistor structures 10 are cut out from the elongated, secondary bonded body 20*b*.

Figure 3B:
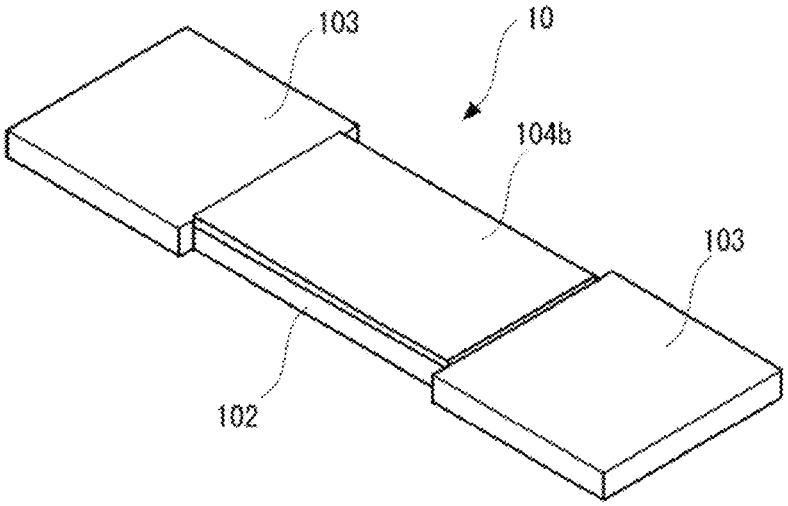
FIG. 3B is a perspective view schematically illustrating one of the plurality of resistor structures of FIG. 3A.

FIG. 3B is a perspective view of a single resistor structure 10 that has been cut out from the secondary bonded body 20*b*. The resistor structure 10 includes a resistive body 102, a pair of electrodes 103 on opposite ends of the resistive body 102, and a layer of thermally conductive material 104*b* on a surface of the resistive body 102 (or in some embodiments, also on the surfaces of the electrodes 103). The resistive body 102, the pair of electrodes 103, and the layer of thermally conductive material 104*b* in the resistor structure 10 correspond with the resistive body member 2, the pair of electrode members 103, and the layer of thermally conductive material 4*b*, respectively, in the secondary bonded body 20*b*.

As shown in FIG. 3B, the resistor structure 10 is oriented during manufacturing so that the layer of semi-cured, semi-hardened, and substantially non-fluid thermally conductive material 104*b* is formed on the top, that is, upward-facing, surface of the resistive body l02 (and in some embodiments, also on the top and upward-facing surfaces of the electrodes 103). In some embodiments, however, the resistive body member 2 and the electrode members 3 are oriented during manufacturing so that the layer of semi-cured, semi-hardened, and substantially non-fluid thermally conductive material 104*b* is formed on the downward-facing surface of the resistive body member 2 (and in some embodiments, also on the downward-facing surfaces of the electrode members 3), for example, in order to form the resistor structure shown in FIGS. 8A and 8B The thermally conductive material 104*b* is semi-cured, semi-hardened and substantially non-fluid. Further, as discussed above, at this stage of the method for manufacturing a resistor according to the present disclosure, the layer of thermally conductive material 104*b* has a predetermined thickness that is thicker than the desired thickness of the completely cured, hardened thermally conductive layer 104*c*.

In some embodiments, the thickness of the layer of semi-cured, semi-hardened and substantially non-fluid thermally conductive material 104*b* is at most about 25% thicker than the desired thickness of the finished, completely cured, hardened thermally conductive layer 104*c*. More preferably, the thickness of the layer of semi-cured, semi-hardened and substantially non-fluid thermally conductive material 104*b* is at most about 5% thicker than the desired thickness of the finished, completely cured, hardened thermally conductive layer 104*c*.

Formation of the resistor structure 10 may be performed in an automatic processing wherein the secondary bonded body 20*b* is fed longitudinally (for example, in the orientation shown in FIG. 3A) into a press machine, which cuts processes the incoming bonded body 20*b* to sequentially produce a plurality of resistor structures 10. The present disclosure does not particularly limit the process by which the resistor structures 10 are formed from the bonded body 20*b*. For example, the resistor structures 10 may be formed by cutting out, stamping out, or punching out the corresponding patterns from the bonded body 20*b*. In some embodiments, a rough template of the resistor structure 10 may be obtained from the bonded body 20*b*, followed by trimming to obtain the specifically desired dimensions for the resistor structure 10. The formation of the resistor structures 10 may be automated, so as to allow for mass-production with a large number of resistor structures 10 obtained in a short period of time.

In the embodiment shown in FIG. 3B, the resistive body 102 has a substantially rectangular shape, and the pair of electrodes 103 each has a substantially rectangular shape. However, it is understood that the geometry and configuration of the resistor structure 10 are not limited to the embodiment depicted in FIG. 3B, and the resistor structure 10 may be shaped to have any configuration considered suitable by a person of ordinary skill in the art, for example, depending on need and the specific application of the final resistor product.

After obtaining the resistor structure, one or more cuts may be formed in the layer of semi-cured, semi-hardened, substantially non-fluid thermally conductive material and the resistive body. In some embodiments, one or more cuts are formed in only the resistive body, and not in the layer of semi-cured, semi-hardened, substantially non-fluid thermally conductive material. In those embodiments where the one or more cuts are formed in only the resistive body, the timing for forming the cuts may depend on the type of thermally conductive material used. For example, in embodiments where a thermally conductive resin film is used, the cuts may be formed in the resistive body member 2 before the thermally conductive resin film is applied onto the surface of the resistive body member 2. On the other hand, in embodiments where a thermally conductive resin paste is used, the cuts may be formed in the resistive body member 2 after the paste has been applied onto the surface of the resistive body member 2, so as to prevent the resin material from flowing into the cuts. The cuts are formed in the resistive body (and in some embodiments, also in the thermally conductive material) so that the electrical resistance of the resistor may be adjusted.

Figure 4:
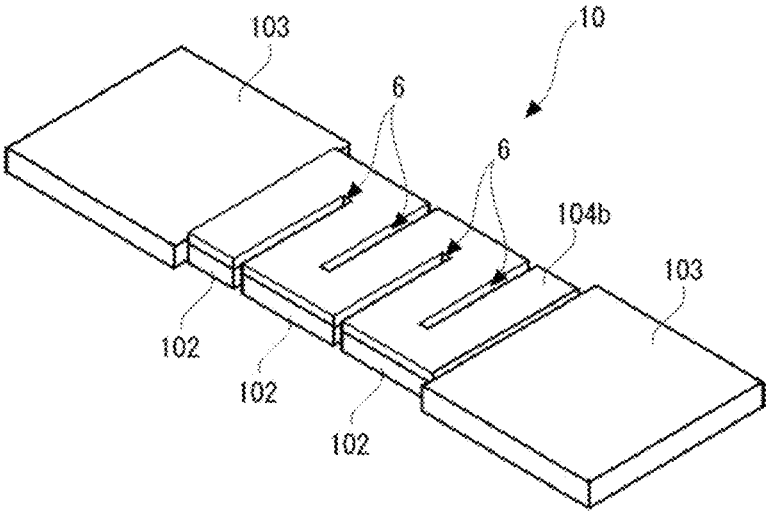
FIG. 4 is a perspective view schematically illustrating the resistor structure of FIG. 3B, in an embodiment according to the present disclosure where a plurality of cuts are formed in the layer of semi-cured, semi-hardened, and substantially non-fluid thermally conductive material and the resistive body.

For example, with reference to FIG. 4, after the resistor structure 10 is obtained, a plurality of cuts 6 may be formed in the thermally conductive material 104*b* and the resistive body 102. As shown in FIG. 4, the plurality of cuts 6 extend through the layer of the thermally conductive material 104*b* and the resistive body 102. Also as shown in FIG. 4, the plurality of cuts 6 are staggered and evenly spaced apart to form a meander pattern. It is understood that the configuration of the cuts 6 is not particularly limited, and that the length, the position, and the number of the cuts 6 may be appropriately adjusted so that the resistive body 102 has a predetermined resistance value.

In conventional methods for manufacturing resistors, such as the method disclosed in Patent Literature No. 1, the thermally conductive material is applied in an uncured, unhardened state, and the electrodes are bent into the uncured, unhardened thermally conductive material before the thermally conductive material is cured. However, when the thermally conductive material is uncured and unhardened, and therefore, fluid, cuts cannot be formed in the material to adjust resistance. The material may not retain the geometry and dimensions of the cut, for example, as a result of the material flowing to fill in the cuts during the subsequent curing process. Also, the material may flow out from the resistor structure when force is applied to it to form the cuts. As such, as compared to the background art, the method for manufacturing a resistor according to the present disclosure advantageously provides a way of easily and flexibly adjusting the resistance of a resistor, without disrupting and complicating manufacturing.

It is also understood that the cuts 6 may be provided as needed, and in some embodiments, the resistor according to the present patent application may be manufactured without one or more cuts 6 in the thermally conductive material 104*b* and the resistive body 102.

The manufacturing method according to this patent application is capable of forming the resistor structure 10 out of the secondary bonded body 20*b* as well as forming one or more cuts 6 in the resistor structure 10 without distorting the cut edges and surfaces of the layer of thermally conductive material. Such protection against distortion is attributed to the thermally conductive layer 4*b*, 104*b* being in the semi-cured, semi-hardened state in which the thermally conductive layer 104*c* has substantially lost the fluidity before cutting process takes place.

After the resistor structure 10 is obtained, the electrodes 103 at the opposite ends of the resistive body 102 are bent toward a surface of the layer of thermally conductive material 104*b*, that is, the surface of the resistive body 102 on which the semi-cured, semi-hardened and substantially non-fluid thermally conductive material 104*b* is provided. The electrodes 103 may be pressed into the thermally conductive material 104*b* to ensure strong bonding between the electrodes 103, the resistive body 102, and the thermally conductive material 104*b*, and because the thermally conductive material 104*b* is semi-cured, semi-hardened and substantially non-fluid, pressing the electrodes 103 into the thermally conductive material 104*b* gradually reduces the thickness of the thermally conductive material 104*b* into the thickness desired of the thermally conductive layer 104*c* in the finished resistor product. The method according to the present disclosure thus makes it possible to produce a resistor with strong adhesion between the constituent components, while maintaining excellent control of the thickness of the thermally conductive layer during manufacturing, so as to impart the resistor with stable heat dissipation capability.

Figure 5A:
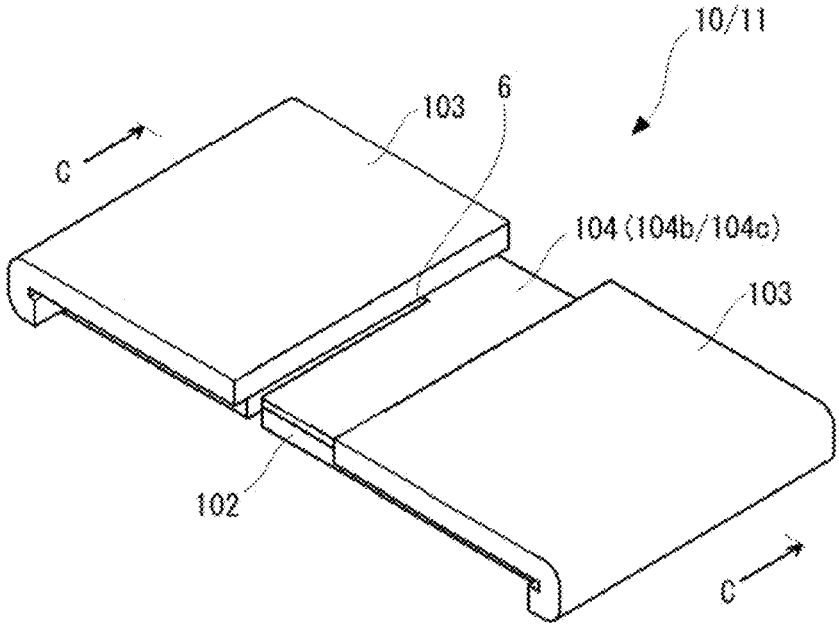
FIG. 5A is a perspective view schematically illustrating the resistor structure of FIG. 4, after bending the pair of electrodes.

In the embodiment illustrated in FIG. 5A, as the layer of thermally conductive material 104*b* is provided on the top, upward-facing surface of the resistive body 102, the electrodes 103 are bent upward toward the surface of the layer of thermally conductive material 104*b*. In the embodiment illustrated in FIG. 8A, when the thermally conductive material is formed on the bottom, downward-facing surface of the resistive body, the electrodes 103 are bent downward toward the surface of the layer of thermally conductive material 104*b*.

Figure 5B:
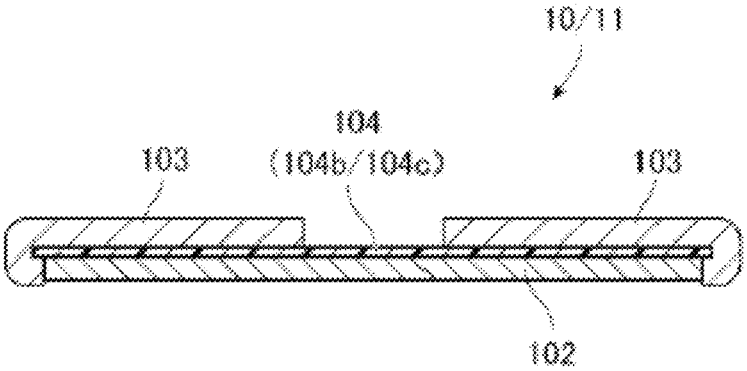
FIG. 5B is a cross-sectional view of the resistor structure, taken along line C-C of FIG. 5A.
Figure 5C:
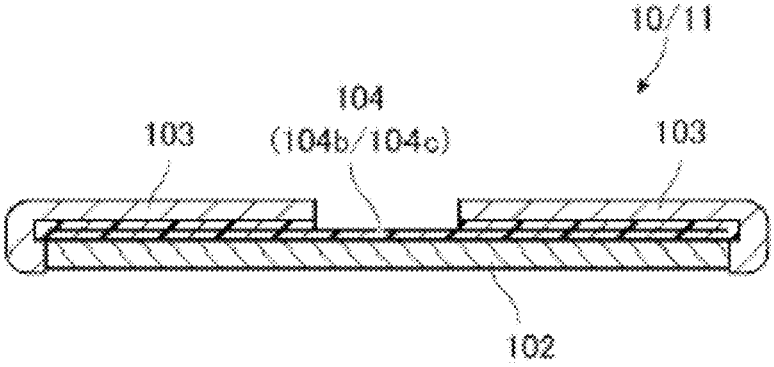
FIG. 5C is a cross-sectional view of a variation of the resistor structure, prepared from the secondary elongated bonded body depicted in FIG. 2C.

FIG. 5B schematically illustrates a cross-section of the resistor structure 10 depicted in FIG. 5A. FIG. 5C depicts a resistor structure 10 that is the same as the embodiment illustrated in FIGS. 5A and 5B, except that the resistor structure is prepared from the bonded body shown in FIG. 2C. FIGS. 5B and 5C omit for brevity the one or more cuts 6 formed in the resistive body 102 and the layer of thermally conductive material 104*by*. Also, although the relative dimensions of the resistive body member 2, the pair of electrode members 3, and the layer of thermally conductive material 4 shown in FIGS. 2B and 2C may appear different from those of the resistive body 102, the pair of electrodes 103, and the layer of thermally conductive material 104 shown in FIGS. 5B and 5C, respectively, it is understood that the drawings are exaggerated illustrations of the substantially same structure in order to show features of the present disclosure, but all dimensional ratios in the structure are maintained.

With continued reference to FIGS. 5A to 5C, each of the bent electrodes 103 has a top surface and a bottom surface, with the bottom surface being the surface that faces the top, upward-facing surface of the resistive body 102. The layer of semi-cured, semi-hardened, and substantially non-fluid thermally conductive material 104*b* is interposed between top surface of the resistive body 102 and the bottom surfaces of the bent electrodes 103.

In the embodiment illustrated in FIG. 5B, the thermally conductive material 4 is provided only on the surface of the resistive body 102, for example, as a result of the resistor structure 10 having been formed using the bonded body depicted in FIGS. 2B and 3B. As such, in the resistor structure 10 shown in FIG. 5B, bending the electrodes 103 results in only a single layer of thermally conductive material 104*b* between the resistive body 102 and the bent electrodes 103.

In the embodiments illustrated in FIG. 5C, the thermally conductive material 4 is provided on the surfaces of both the resistive body 102 and the pair of electrodes 103, for example, as a result of the resistor structure 10 having been formed using the bonded body depicted in FIG. 2C. As such, in the resistor structure 10 depicted in FIG. 5C, bending the electrodes 103 results in two layers of thermally conductive material 104*b* between the resistive body 102 and the bent electrodes 103, and a single layer of thermally conductive material 104*b* at the center part where no portions of the bent electrodes 103 face the resistive body 102.

Subsequent to bending the pair of electrodes 103, the layer of semi-cured, semi-hardened and substantially non-fluid thermally conductive material 104*b* is subject to a second curing to become completely cured and hardened, so as to form a resistor 11 having a completely cured and hardened thermally conductive layer 104*c* between the resistive body 102 and the electrodes 103. The definition of the term "complete curing" or "complete hardening" is as described above.

Although the present disclosure does not particularly limit the thermal processing condition for the second curing, it is preferable to heat the thermally conductive material 104*b* at an application temperature in the range from approximately 150° C. to approximately 250° C. for a duration of approximately 0.5 hours to approximately 2 hours. A person of ordinary skill in the art would understand that the heating time and temperature required for curing or hardening process may vary depending on the particular thermally conductive material used. Where a pre-manufactured, commercially available, purchased thermally conductive material is used, curing may be performed in accordance with the conditions prescribed by the manufacturer. For example, for a resin used in experiments described hereinbelow, the application temperature may be adjusted as needed in the range from approximately 160° C. to approximately 200° C., and the application time may be adjusted as needed in the range from approximately 70 minutes to approximately 30 minutes. Generally, where the curing conditions are experimentally determined, the lower the application temperature is, the longer the application time is set.

To obtain a completely cured and hardened thermally conductive layer 104*c*, pressure is applied on the pair of bent electrodes 103, while simultaneously heating the semi-cured, semi-hardened and substantially non-fluid thermally conductive material 104*b* to cause further curing and hardening of the thermally conductive material 104*b*.

More specifically, it is preferable to perform the second curing while pressing the bent electrodes 103 against the layer of semi-cured, semi-hardened and substantially non-fluid thermally conductive material 104*b* on the resistive body 102. That is, in the example depicted in FIG. 5B, the layer of thermally conductive material 104*b* is completely cured and hardened by being heated under pressure while in contact with the bent electrodes 103. In the example depicted in FIG. 5C, the two layers of thermally conductive material 104*b*, one engaging the bottom surfaces of the electrodes 103 and the other engaging the top surface of the resistive body 102, are completely cured and hardened by being heated under pressure while the two thermally conductive layers 104*b* are superimposed one upon another. Because the thermally conductive material 104*b* is semi-cured, semi-hardened and substantially non-fluid, pressing the electrodes 103 against the layer of semi-cured, semi-hardened and substantially non-fluid thermally conductive material 104*b* gradually reduces the thickness of the thermally conductive material 104*b* into the thickness desired of the thermally conductive layer 104*c* in the finished resistor product. The method according to the present disclosure thus makes it possible to produce a resistor with strong adhesion between the constituent components, while maintaining excellent control of the thickness of the thermally conductive layer during manufacturing, so as to impart the resistor with stable heat dissipation capability.

Simultaneous application of heat and pressure to the thermally conductive material enables the resistive body 102 to firmly adhere to the pair of electrodes 103 via the completely cured and hardened thermally conductive layer 104*c*, so as to securely fix the resistive body 102 and the electrodes 103 to each other.

Further, the second curing applying heat and pressure causes the layer of semi-cured, semi-hardened, substantially non-fluid thermally conductive material 104*b* to assume a slightly reduced thickness once the thermally conductive material 104*b* is set, such that the completely cured, hardened thermally conductive layer 104*c* has the desired thickness. Thus, the resistor may be manufactured with accurate control of the thickness of the thermally conductive layer 104*c*.

In some embodiments, the thickness of the layer of semi-cured, semi-hardened and substantially non-fluid thermally conductive material 104*b* is at most about 25% thicker than the desired thickness of the finished, completely cured, hardened thermally conductive layer 4. More preferably, the thickness of the uncured, unhardened thermally conductive material 4*a* is at most about 5% thicker than the desired thickness of the finished, completely cured, hardened thermally conductive layer 104*c*.

Accordingly, once the cured and hardened thermally conductive layer 104*c* is obtained, the resistive body 102, the completely cured and hardened thermally conductive layer 104*c*, and the pair of electrodes 103 are firmly bonded to each other, and the cured and hardened thermally conductive layer 104*c* has substantially the predetermined thickness.

Figure 6A:
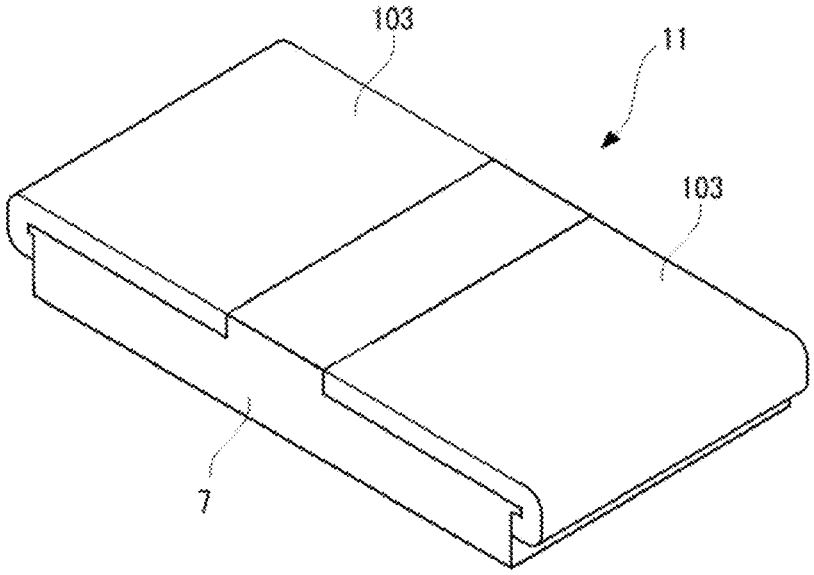
FIG. 6A is a perspective view schematically illustrating the resistor structure of FIG. 5A, in an embodiment according to the present disclosure where a protective layer is provided.
Figure 6B:
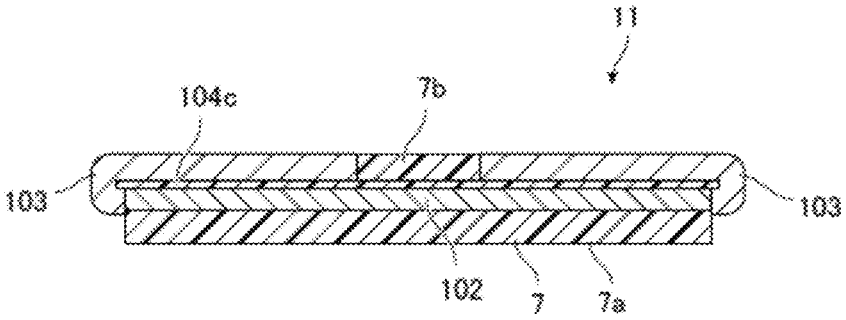
FIG. 6B is a cross-sectional view of the resistor structure depicted in FIG. 6A.
Figure 6C:
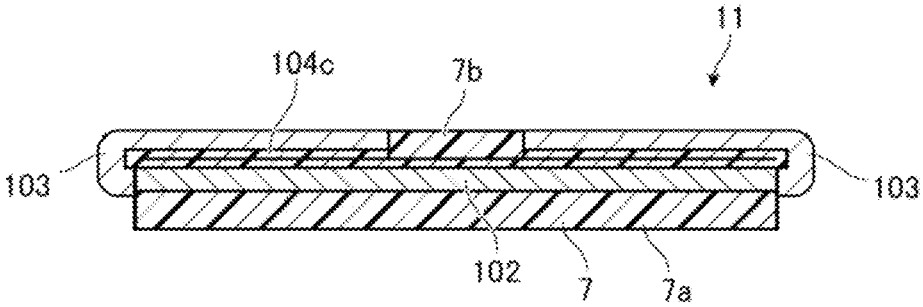
FIG. 6C is a cross-sectional view of a resistor structure according to another embodiment of the present embodiment, prepared from the resistor structure of FIG. 5C.
Figure 8A:
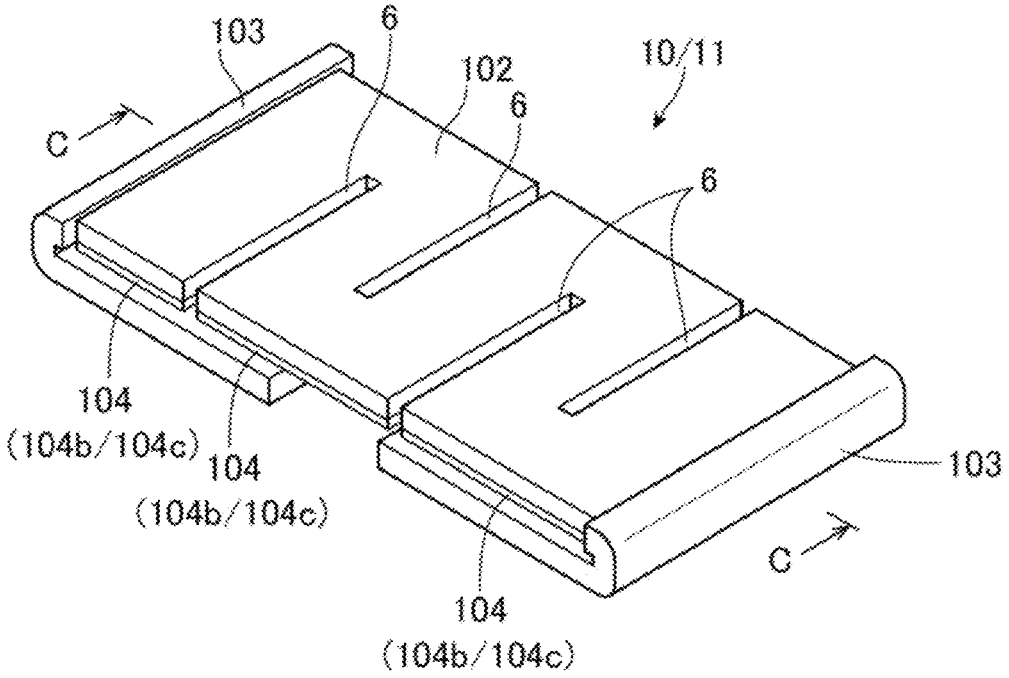
FIG. 8A is a perspective view schematically illustrating a resistor structure formed by a method of manufacturing a resistor according to another embodiment of the present disclosure.
Figure 8B:
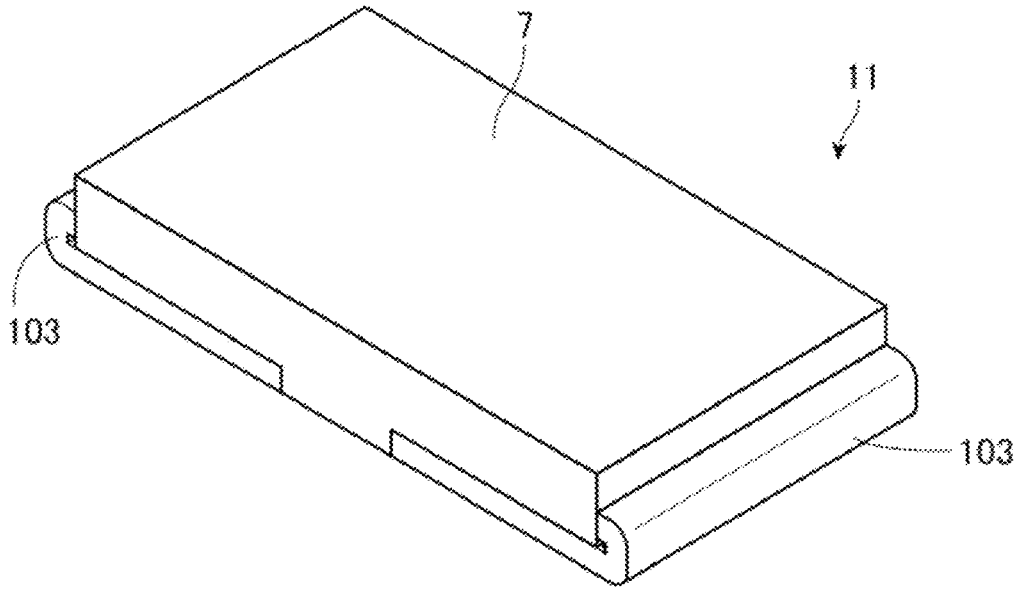
FIG. 8B is a perspective view schematically illustrating the resistor structure of FIG. 8A, in an embodiment according to the present disclosure where a protective layer is provided.

In some embodiments, a protective layer may be provided on the resistive body. With reference to FIGS. 6A to 6C, after the second curing to form the completely cured and hardened thermally conductive layer 104*c*, a protective layer 7 is mold-formed on the surface of the resistive body 102. In some embodiments, the protective layer 7 covers all exposed surfaces of the resistive body 102 and the completely cured and hardened thermally conductive layer 104*c*, for example, as shown in FIG. 6A. FIG. 6B depicts the resistor structure of FIG. 5B provided with the protective layer 7, and FIG. 6C depicts the resistor structure of FIG. 5C provided with the protective layer 7. FIG. 8B depicts the resistor structure of FIG. 8A, which is formed with the thermally conductive layer 104*c* on the bottom, downward-facing surface of the resistive body 102, and which is provided with the protective layer 7.

Preferably, the protective layer 7 is formed of a material with excellent heat resistance and electrical insulation properties. Examples of the material for mold-forming the protective layer 7 include, but are not limited to, a resin, glass, inorganic material and the like.

As depicted in FIGS. 6B and 6C, the protective layer 7 includes a first protective portion 7*a* that covers the surface of the resistive body 102, and a second protective portion 7*b* that fills the gap between the opposed edges of the pair of electrodes 103 on the resistive body 102 and the thermally conductive layer 104*c*. In embodiments where the thermally conductive layer 104*c* is formed on the downward-facing surface of the resistive body, the second protective portion fills the gap between the opposed edges of the pair of electrodes 103 underneath the resistive body 102 and the thermally conductive layer 104*c*, for example, as shown in FIG. 8B. Also, the second protective portion 7*b* and the electrodes 103 together constitute a substantially flush surface on the surface of the resistor structure.

Further, although not depicted in the drawings, a seal or stamping may be provided on the surface of the first protection portion 7*a*.

Figure 7A:
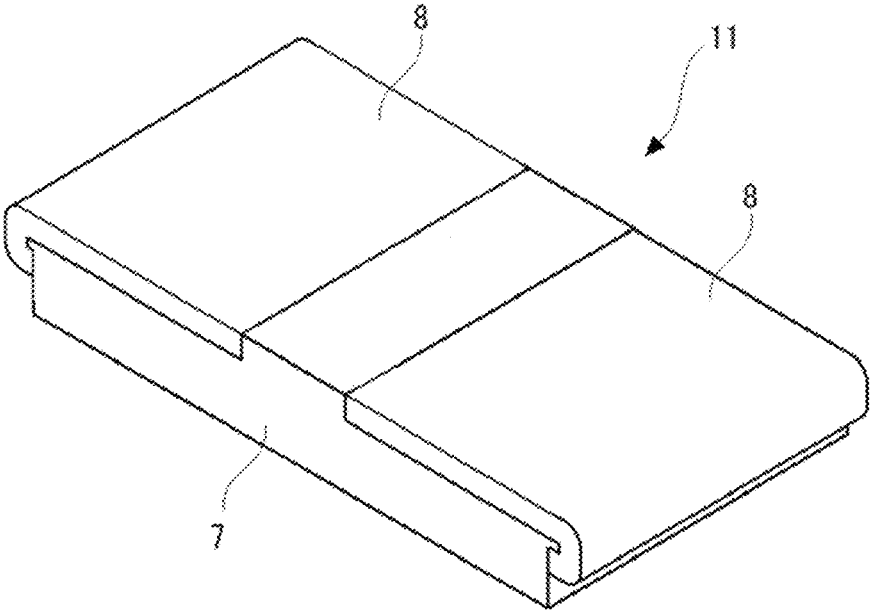
FIG. 7A is a perspective view schematically illustrating the resistor structure of FIG. 6A, in an embodiment according to the present disclosure where the electrodes are plated.
Figure 7B:
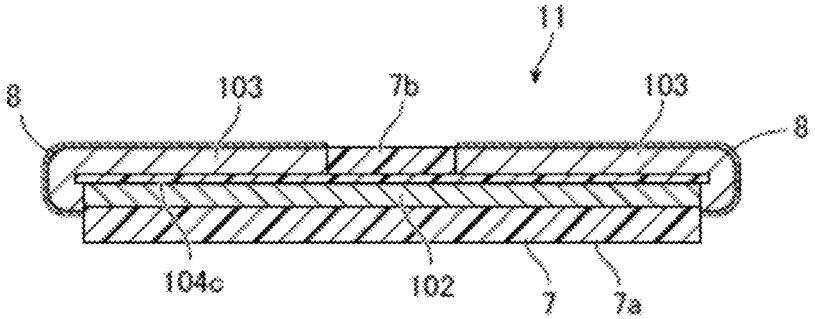
FIG. 7B is a cross-sectional view of the resistor structure depicted in FIG. 7A.
Figure 7C:
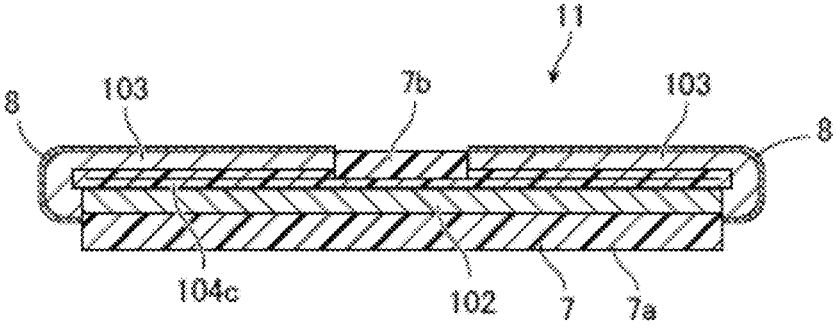
FIG. 7C is a cross-sectional view of a resistor structure according to another embodiment of the present embodiment, prepared from the resistor of FIG. 6C.

In some embodiments, for example, as depicted in FIGS. 7A, 7B, and 7C, after forming the protective layer 7, the surfaces of the electrodes 103 may be plated to form a plating layer 8. FIG. 7B depicts the resistor structure of FIG. 6B provided with the plating layer 8, and FIG. 7C depicts the resistor structure of FIG. 6C provided with the plating layer 8. Though not shown, plating may also be performed on the resistor illustrated in FIG. 8B.

Examples of the material for forming the plating layer 8 include, but are not limited to, copper, nickel and the like. The plating layer 8 serves to expand the contact area where the resistor 11 contacts a substrate surface on which the resistor 11 is disposed, and to prevent soldering erosion of the electrode 103 upon soldering of the resistor 11 to the substrate surface. The plating process is carried out as needed.

(Resistor)

Another aspect of the present disclosure is a resistor. The resistor may be manufactured according to the method described above. The resistor 11 includes a resistive body 102, a pair of electrodes 103 that are disposed at opposite ends of the resistive body 102 and that are folded so that a portion of each electrode 103 overlaps with the resistive body 102, and a cured and hardened thermally conductive layer 104*c* interposed between the resistive body 102 and the folded portions of the electrodes 103, for example, as depicted in FIGS. 7B and 7C.

The thickness of the thermally conductive layer 104*c* ranges from approximately 10 μm to approximately 200 μm, and more preferably, from approximately 50 μm to approximately 150 μm, and most preferably, from approximately 80 μm to 100 μm. In the embodiment illustrated in FIG. 7C, the thickness of the thermally conductive layer 104*c* interposed between the resistive body 102 and the electrodes 103 represents the total thickness of the double layers, but it is understood that in embodiments where the thermally conductive layer 104*c* is a single layer, the range of thickness disclosed above also applies.

When the thickness of the thermally conductive layer 104*c* is within the above thickness range, heat can appropriately dissipate from the resistive body 102 to the electrodes 103 via the thermally conductive layer 104*c*. Moreover, controlling the thickness of the thermally conductive layer 104*c* to be in the above range improves tightness of contact, or adhesion strength, between the resistive body 102 and the electrodes 103 via the thermally conductive layer 104*c*, which in turn effectively reduces occurrence of defects, such as peeling of the electrodes 103 from the thermally conductive layer 104*c* and cracks in the thermally conductive layer 104*c*.

Further, in the method for manufacturing the resistor according to the present disclosure, the thermal conductive layer 104*c* may be formed by performing a first curing of a layer of uncured, unhardened thermally conductive material to obtain a layer of semi-cured, semi-hardened, substantially non-fluid thermally conductive material; bending the electrodes toward the layer of semi-cured, semi-hardened, substantially non-fluid thermally conductive material; and then performing a second curing of the semi-cured, semi-hardened, substantially non-fluid thermally conductive material to obtain the fully cured, hardened thermal conductive layer 104*c*. Moreover, the resistor structure may be processed (for example, by forming one or more cuts in the layer of semi-cured, semi-hardened, substantially non-fluid thermally conductive material after the first curing) to adjust electrical resistance to a predetermined value.

The above-described manufacturing process reduces variations in the thickness of the thermally conductive layer 104*c* between the resistive body 102 and the electrodes 103 in comparison with background art process. That is, when bending the electrodes 103 and performing the second curing, the layer of thermally conductive material 104*b* is in the semi-cured, semi-hardened state, that is, the thermally conductive material 104*b* is neither uncured or unhardened, nor completely cured or hardened. It is therefore possible to reduce variations in thickness when preparing the thermally conductive layer 104*c*. Such variations typically result from fluidity of the thermally conductive material, for example, when the bending of the electrodes and other manufacturing process are performed with a layer of uncured, unhardened and fluid thermally conductive material between the resistive body and the electrodes.

Because the method for manufacturing a resistor according to the present disclosure reduces variations in the thickness of the thermally conductive layer 104*c* between the resistive body 102 and the electrodes 103, a resistor with uniform thickness or spacing between the resistive body 102 and the electrodes 103, as well as reduced variations in the heat dissipation property, can be obtained. The resistor is produced with consistent, excellent heat dissipation capability. Maintaining a uniform thickness or spacing between the resistive body 102 and the electrodes 103 prevents gaps or other irregularities between the resistive body 102 and the electrodes 103, leading to improved bonding or adhesive strength therebetween.

The thermally conductive layer 104*c* is preferably formed by applying a thermally conductive resin film 4*a* that is uncured, unhardened and solidified onto the resistive body member 2, and then performing the necessary curing.

The use of the uncured, unhardened and solidified thermally conductive resin film 4*a*, which is subsequently semi-cured and semi-hardened before a final curing to obtain a completely cured, hardened thermally conductive layer 104*c*, allows for a better controlled, more uniform thickness between the resistive body 102 and the electrodes 103.

In the step depicted in FIGS. 5A, 5B, and 5C, it is preferable to cure the semi-cured, semi-hardened thermally conductive material 104*b* while simultaneously pressing the bent electrodes 103 against the layer of thermally conductive material 104*b*. Simultaneously pressing the electrodes 103 during curing enables the electrodes 103 to securely adhere to the resistive body 102 via the thermally conductive layer 104*c* therebetween. Further, because the thermally conductive material 104*b* is semi-cured, semi-hardened and substantially non-fluid, pressing the electrodes 103 against the layer of semi-cured, semi-hardened and substantially non-fluid thermally conductive material 104*b* does not cause any significant reduction in the thickness of the thermally conductive material 104*b*. The present disclosure thus makes it possible to produce a resistor that only has strong adhesion between the constituent components, but that also has a uniform thermally conductive layer which enables excellent and stable heat dissipation capability.

The present invention will be described in more detail with reference to examples in which experimental data is obtained to accomplish beneficial effects of the present invention. However, the present invention is not limited to the examples as described below.

Example 1

An experiment was conducted using a resin as the thermally conductive material, and a thermal analysis was carried out using a differential scanning calorimeter (DSC).

Specifically, the resin used in the experiment was a polyimide/epoxy resin, and the differential scanning calorimeter used was DSC8231, manufactured by Rigaku Corporation.

Figure 9:
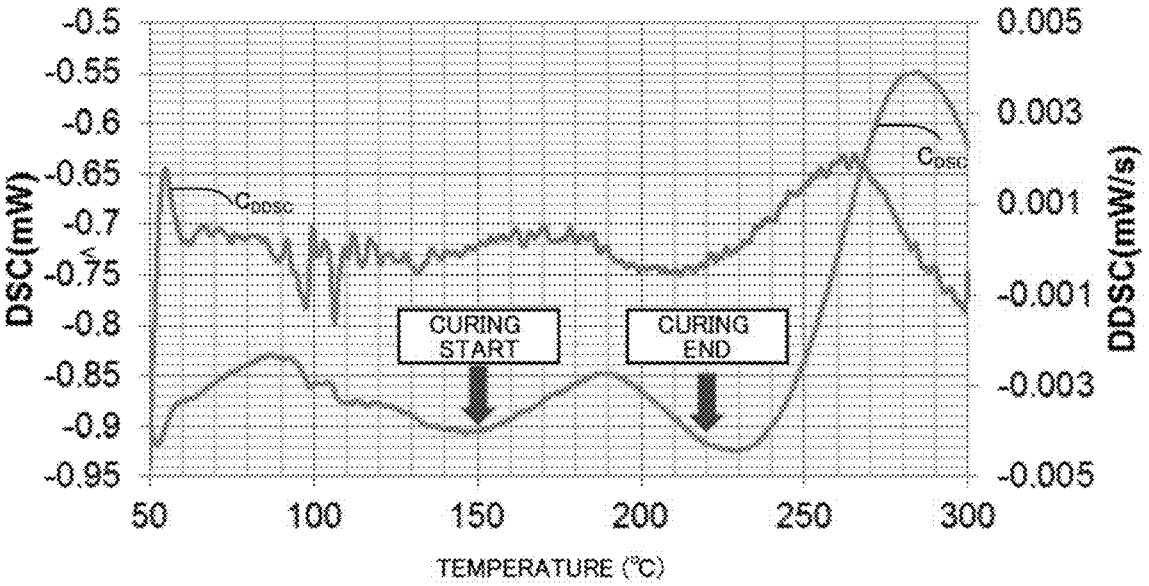
FIG. 9 is a graph showing a DSC curve and a DDSC curve of a polyimide/epoxy resin.

FIG. 9 is a graph plotting DSC curve CDSC and DDSC curve CDDSC obtained in the experiment where heat was applied at a temperature elevation rate of 10° C./min.

As shown in FIG. 9, the curing of the resin started at a temperature of approximately 150° C., and completed at a temperature of approximately 220° C. At temperatures of 230° C. or higher, the resin underwent thermal oxidation, and discoloration and/or brittleness of the surface of the resin were.

In accordance with the experimental results, the curing temperature for the resin was determined to be in the range from 160° C. to 220° C.

Figure 10:
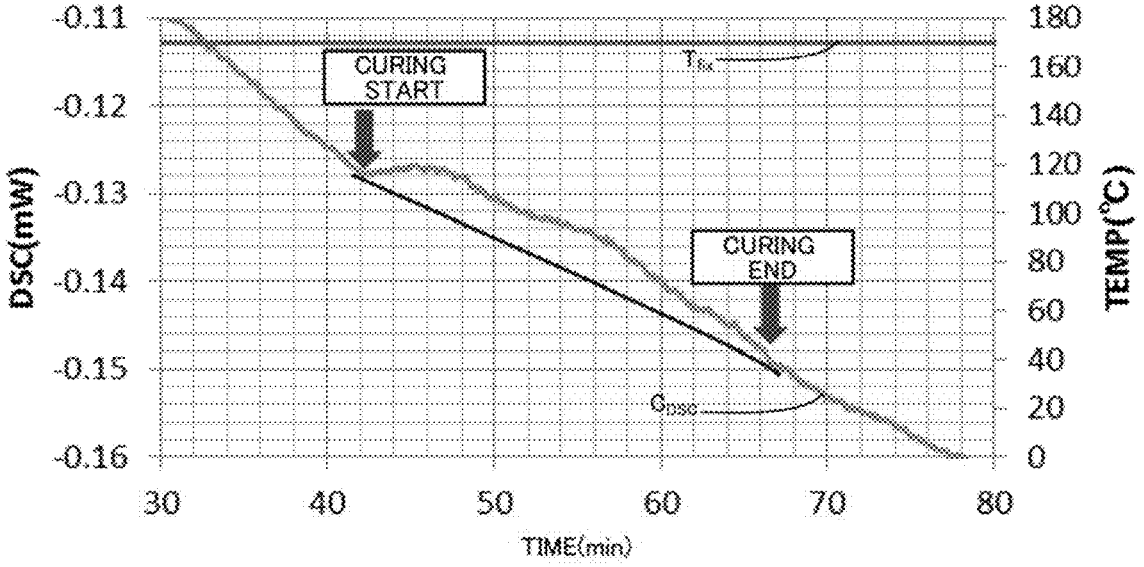
FIG. 10 is a graph showing a DSC curve of the polyimide/epoxy resin measured at a fixed temperature of 170° C.

Next, thermal analysis was conducted in which the sample was heated at a fixed temperature of 170° C. FIG. 10 is a graph plotting a DSC curve CDSC against holding time in minutes, obtained at a fixed temperature $T_{fix}$ of 170° C., and identifies the point when curing started and the point when curing was complete.

As shown in FIG. 10, the curing started when the sample was heated for a duration of approximately 42 minutes, and the curing was complete when the sample was heated for a duration of approximately 67 minutes.

The above-described experimental results show that heating at a temperature of 170° C. for a duration of approximately 60 minutes is required for causing complete curing of the polyimide/epoxy resin specified above. Such experimentally obtained curing conditions are consistent with curing conditions recommended by the manufacturer of the resin.

With the curing conditions determined to be a temperature of 170° C. for a duration of approximately 60 minutes, curing conditions for other temperatures may be determined accordingly: for example, heating at 160° C. for approximately 70 minutes, 170° C. for approximately 60 minutes, 180° C. for approximately 50 minutes, 190° C. for approximately 40 minutes, and 200° C. for approximately 30 minutes.

Heating conditions to cause semi-curing and semi-hardening may be established based on the curing conditions described above, for example, by reducing the duration of time to approximately 10% to 50% of the duration of time for complete curing at each of the application temperatures. For example, at the application temperature of 170° C., the application time may be set to approximately 6 to 30 minutes to cause semi-curing of the resin.

Example 2

Changes in the thickness of the same resin material as in Example 1 was tested. A primary bonded body was provided as described in the present disclosure. An uncured, unhardened resin film, which was composed of polyimide/epoxy resin and which had a thickness of 100 μm, was applied to the resistive body member of the primary bonded body. A first curing was performed in accordance with the curing conditions determined in Example 1 to produce a secondary bonded body having a layer of semi-cured, semi-hardened, and substantially non-fluid resin material. No pressure was applied during the first curing. The thickness of the layer of semi-cured, semi-hardened, and substantially non-fluid resin material was measured to be 100 μm. The electrodes were bent into the layer of semi-cured, semi-hardened, and substantially non-fluid resin material. A second curing was performed in accordance with the curing conditions determined in Example 1 to produce a resistor having a layer of the completely cured and hardened resin material between the resistive body and the electrodes. Pressure was applied during the second curing to firmly adhere the components to each other. The thickness of the completely cured and hardened resin material was measured to be 80 μm.

INDUSTRIAL APPLICABILITY

The resistor according to the present invention exhibits excellent heat dissipation property while allowing a thin, compact design of the resistor. The resistor may be surface-mounted for application to various types of circuit boards.

The invention claimed is:

1. A method for manufacturing a resistor, the method comprising the steps of:

providing a resistor structure comprising a resistive body, a pair of electrodes on opposite ends of the resistive body, and a layer of first thermally conductive material covering at least a surface of the resistive body, the first thermally conductive material being semi-cured, semi-hardened and substantially non-fluid, and the layer of first thermally conductive material having a first thickness;

bending the pair of electrodes at the opposite ends of the resistive body toward a surface of the layer of first thermally conductive material; and pressing the pair of electrodes against the surface of the layer of first thermally conductive material, while maintaining in a heated state the first thermally conductive material to cause further curing and hardening of the first thermally conductive material and a reduction in the first thickness, so as to obtain a cured and hardened thermally conductive layer having a desired second thickness, so that the resistive body, the cured and hardened thermally conductive layer and the pair of electrodes are firmly bonded to each other.

2. The method according to claim 1, wherein the step of providing the resistor structure comprises:

forming an elongated bonded body by adhering a pair of electrode members to opposite surfaces of an elongated resistor body member, and applying a layer of second thermally conductive material on at least a surface of the elongated resistor body member, the second thermally conductive material being uncured and unhardened;

partially curing the layer of second thermally conductive material; and cutting out the resistor structure from the elongated bonded body.

3. The method according to claim 1, wherein the first thermally conductive material has a degree of hardness substantially in the range of from 30% to 70% of a degree of hardness of the cured and hardened thermally conductive layer.

4. The method according to claim 1, further comprising, before bending the pair of electrodes, forming a plurality of cuts in at least the resistive body.

5. The method according to claim 1, further comprising, before applying the layer of first thermally conductive material to at least the surface of the resistive body, forming a plurality of cuts in the resistive body.

6. The method according to claim 1, wherein the first thermally conductive material has a degree of cure in the range of from 30% to less than 70%, and wherein the cured and hardened thermally conductive layer has a degree of cure equal to or higher than 70%.

7. The method according to claim 1, wherein the first thickness is at most 5-25% thicker than the second thickness.

8. The method according to claim 6, wherein the second thickness is in the range of from 50 μm to 95 μm.

9. The method according to claim 1, wherein the layer of first thermally conductive material covers a downward-facing surface of the resistive body, and the pair of electrodes are bent downward toward the surface of the layer of first thermally conductive material.

10. A resistor formed by the method according to claim 1.

* * * * *